US005337591A

United States Patent [19]

Fordee et al.

[11] Patent Number: 5,337,591

[45] Date of Patent: Aug. 16, 1994

[54] MACHINE AND METHOD OF MAKING DUCT COUPLING

[75] Inventors: William H. Fordee, Townville, S.C.; Henry M. Keating, St. Clair Shore, Mich.

[73] Assignee: Keating Koupling, Inc., Six Mile, S.C.

[21] Appl. No.: 907,872

[22] Filed: Jul. 2, 1992

[51] Int. Cl.[5] ..... B21D 7/08

[52] U.S. Cl. ..... 72/168; 72/172; 72/173; 72/177

[58] Field of Search ..... 72/168, 172, 173, 175, 72/170, 177

[56] References Cited

U.S. PATENT DOCUMENTS

| | | | |
|---|---|---|---|
| 1,771,955 | 7/1930 | Fork | 72/168 |
| 1,843,064 | 1/1932 | Chesney | 72/177 |
| 2,103,142 | 12/1937 | Bowers | 72/168 |
| 2,257,760 | 10/1941 | Nyberg . | |
| 2,775,284 | 12/1956 | Hermann . | |
| 3,319,445 | 5/1967 | Stalker | 72/30 |
| 3,472,056 | 10/1969 | Gregg | 72/369 |
| 4,080,815 | 3/1978 | Foster | 72/168 |
| 4,562,630 | 1/1986 | Larsson | 29/157.3 |

FOREIGN PATENT DOCUMENTS

| | | | |
|---|---|---|---|
| 2595967 | 9/1987 | France | 72/168 |
| 16635 | 7/1968 | Japan | 72/168 |
| 29710 | 9/1973 | Japan | 72/168 |
| 202133 | 11/1984 | Japan | 72/168 |
| 519246 | 6/1976 | U.S.S.R. | 72/168 |
| 494898 | 8/1981 | U.S.S.R. | 72/168 |

*Primary Examiner*—Daniel C. Crane
*Attorney, Agent, or Firm*—Brooks & Kushman

[57] ABSTRACT

A machine for coiling a sheet metal strip having a pair of lateral flanges joined by a channel shaped rib with oppositely opening lateral grooves where the rib is on the outside of the coil, includes a pair of cooperating fluting rolls between which the strip is fed to flute the flanges, one roll being circumferentially grooved to receive the rib of the strip, and a wedge shaped coiling shoe is positioned to receive the strip from the rolls. The shoe has three strip coiling ramps, two of which bear against the flanges and embrace the rib, and the third bears against the top of the rib. These ramps are positioned to deflect the strip into a coiled configuration. A pair of ears on the coiling shoe enters the oppositely opening lateral grooves and cooperatively with the fluting of the flanges prevents collapse or distortion of the grooves.

10 Claims, 5 Drawing Sheets

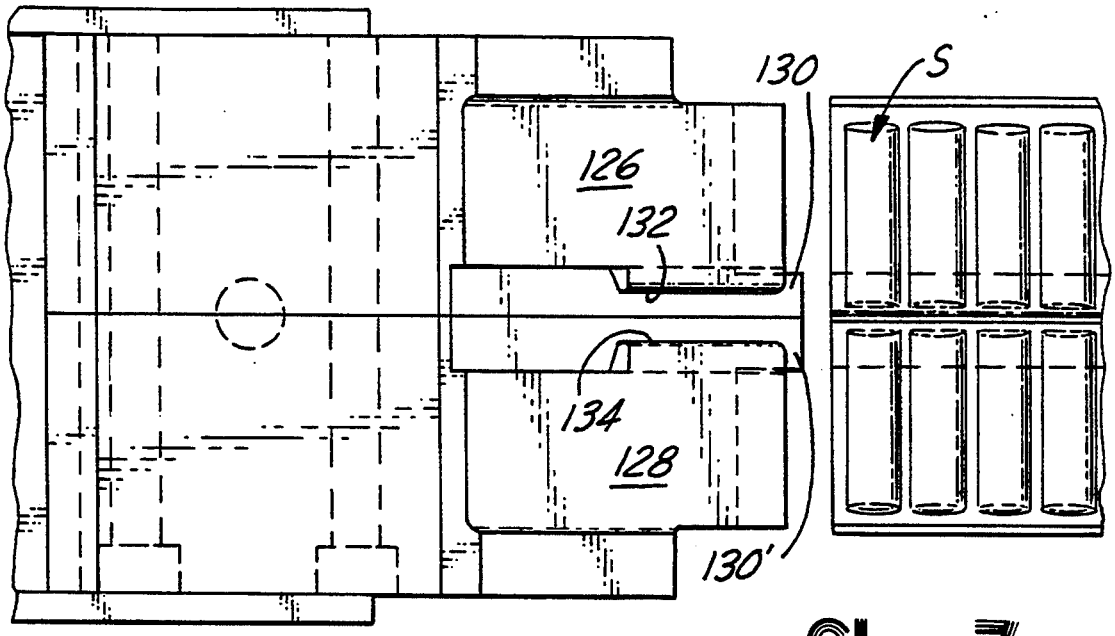
Fig-7
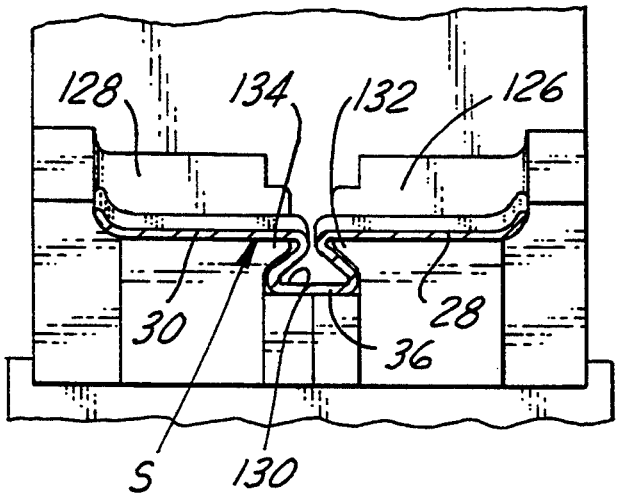
Fig-8
Fig-11
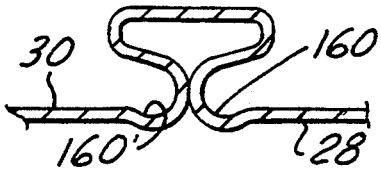
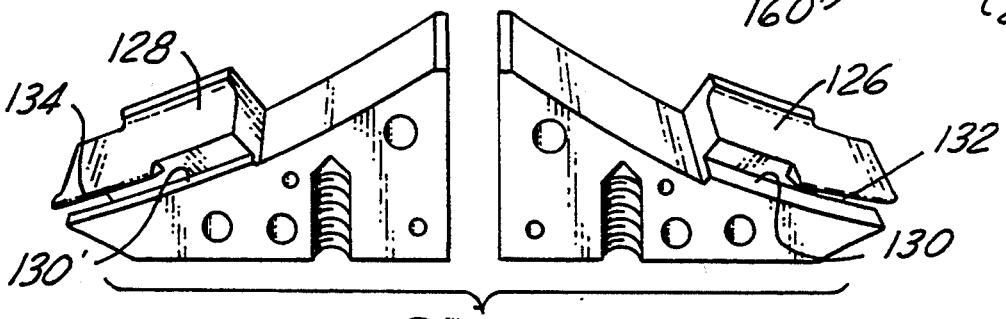
Fig-9

MACHINE AND METHOD OF MAKING DUCT COUPLING

FIELD OF INVENTION

This invention relates to a machine for coiling a sheet metal strip in making a coupling ring for receiving and joining circular air ducts.

RELATED APPLICATIONS

This application incorporates by reference co-pending application Ser. No. 776,592 , filed Oct. 11, 1991, now U.S. Pat. No. 5,213,374, issued May 25, 1993.

BACKGROUND OF THE INVENTION

In the above-mentioned co-pending application, a coupling ring is disclosed for receiving and joining circular air ducts. The coupling ring comprises a sheet metal strip having a pair of lateral flanges joined by a channel-shaped rib which overhangs the flanges and defines therebetween oppositely opening lateral grooves. The strip is formed in a roll forming machine from flat metal stock. A length of the strip is bent into a coil with the rib on the outside and the ends of the strip are brought together and secured as by welding to a butt block. When it was attempted to coil the strip with the rib on the outside of the coil, it was discovered that the oppositely opening lateral grooves were substantially distorted preventing proper entry and seating of the ends of the ducts and resulted in an unsatisfactory joint between the ducts. Distortion of the oppositely opening lateral grooves was also a serious drawback because in use the coupling ring has sealant material disposed in the grooves and the ends of the ducts are simply to be buried in sealant and then secured to the flanges with fasteners. With distorted grooves the sealant does not properly cover the ends of the ducts and air leaks occur.

Various attempts were made to coil the strip, and prior art machines were considered for possible use in this connection. A search of the prior art uncovered the following patents, none of which discloses a machine suitable for coiling the strip:

U.S. Pat. No. 2,257,760
U.S. Pat. No. 2,775,284
U.S. Pat. No. 3,319,445
U.S. Pat. No. 3,472,056
U.S. Pat. No. 4,080,815
U.S. Pat. No. 4,562,630

In analyzing the distortion occurring in the oppositely opening lateral grooves during attempts to coil the strip, it was noted that the rib was subjected to tensile stresses while the lateral flanges were under compression. These oppositely directed stresses within the strip are focused close to the oppositely opening grooves during the coiling and resulted in distortion of the grooves.

SUMMARY OF THE INVENTION

This invention provides a machine which will permit the coiling of the strip without undesirable distortion of the oppositely opening lateral grooves. During coiling, according to the invention herein disclosed, a shallow distortion of the lateral flanges occurs adjacent the grooves. This slight distortion creates a shallow pocket which receives and holds sealant material placed in the grooves. Thus even though the ends of the ducts tend to wipe the flanges as the ends are telescoped into the grooves, the retained sealant in these pockets serves to effect a seal between the flanges and the ends of the ducts.

It was discovered that in order to avoid distortion of the strip during coiling it was necessary both to flute the lateral flanges and support the rib against collapse while bending the strip into a curved shape. To accomplish this, the strip is fed between a pair of cooperating fluting rolls which serve to flute the flanges of the strip. One roll of the pair is circumferentially grooved to receive the channel-shaped rib of the strip. A coiling shoe having strip coiling surfaces including a pair of laterally spaced apart ramps for engaging the flanges and a cooperating third ramp for engaging and coiling the channel-shaped rib is positioned closely adjacent the fluting rolls. The coiling shoe is so positioned in relation to the fluting rolls that the coiling surfaces deflect the strip emerging from the rolls into a coil having the channel-shaped rib on the outside of the curve. A pair of ears disposed adjacent the pair of ramps are received in the oppositely opening grooves of the strip and are shaped to substantially fill each such groove and prevent collapse of the rib during coiling of the strip.

The coiling shoe is mounted for vertical and horizontal adjustment toward and away from the rolls and tilting to allow the coiling of different diameter coupling rings and slightly vary the shape of the strip.

DESCRIPTION OF THE DRAWINGS

FIG. 7 is a plan view taken on the line 7—7 of FIG. 5;

FIG. 8 is a cross-sectional view taken on the line 8—8 of FIG. 5;

FIG. 9 is a perspective fragmentary view of a coiling shoe;

FIG. 11 is an enlarged fragmentary cross-sectional view through a strip coiled in the machine showing shallow sealant receiving pockets.

BRIEF DESCRIPTION OF PREFERRED EMBODIMENTS

Figure 1:
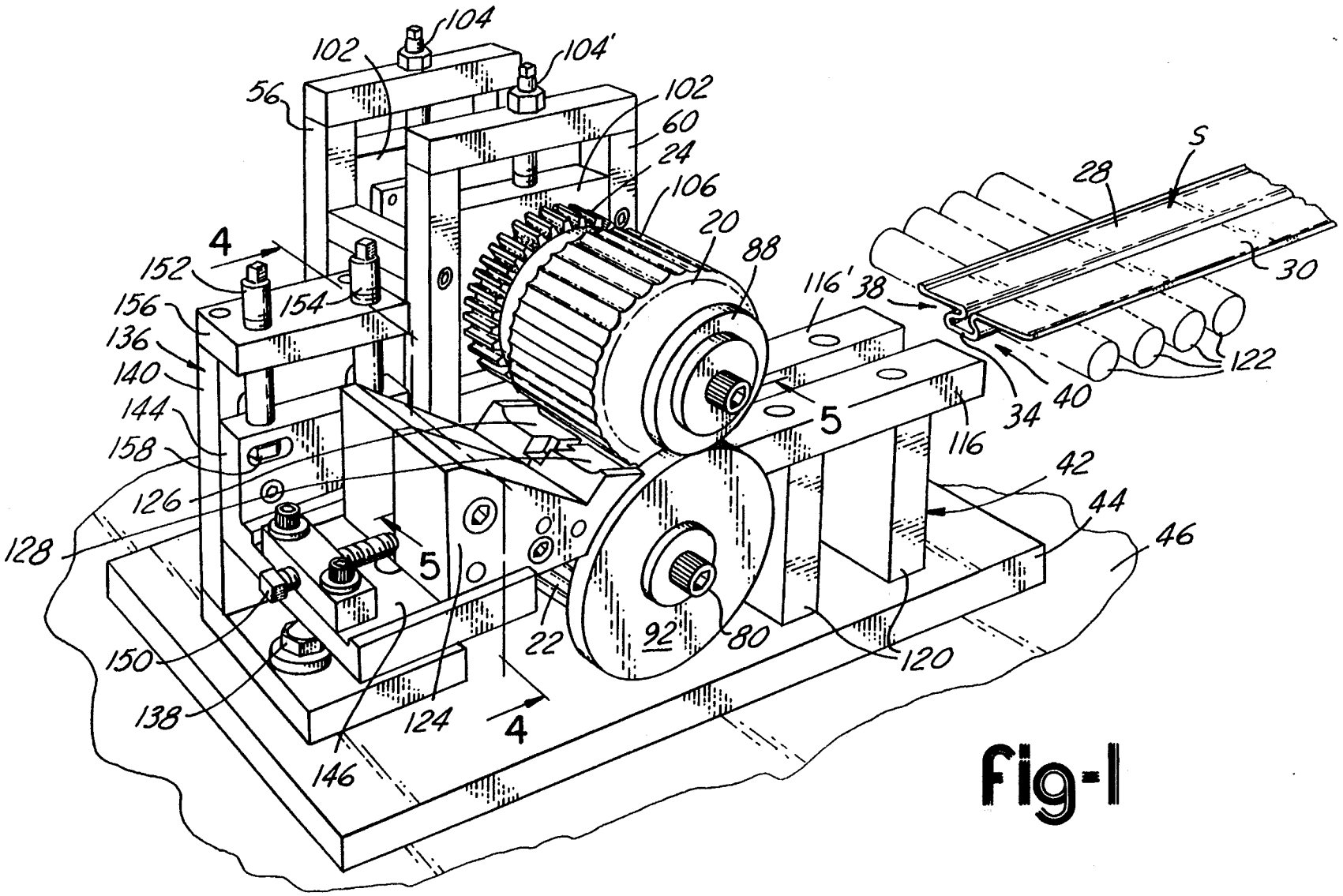
FIG. 1 is a perspective view of a coiling machine embodying the invention.
Figure 2:
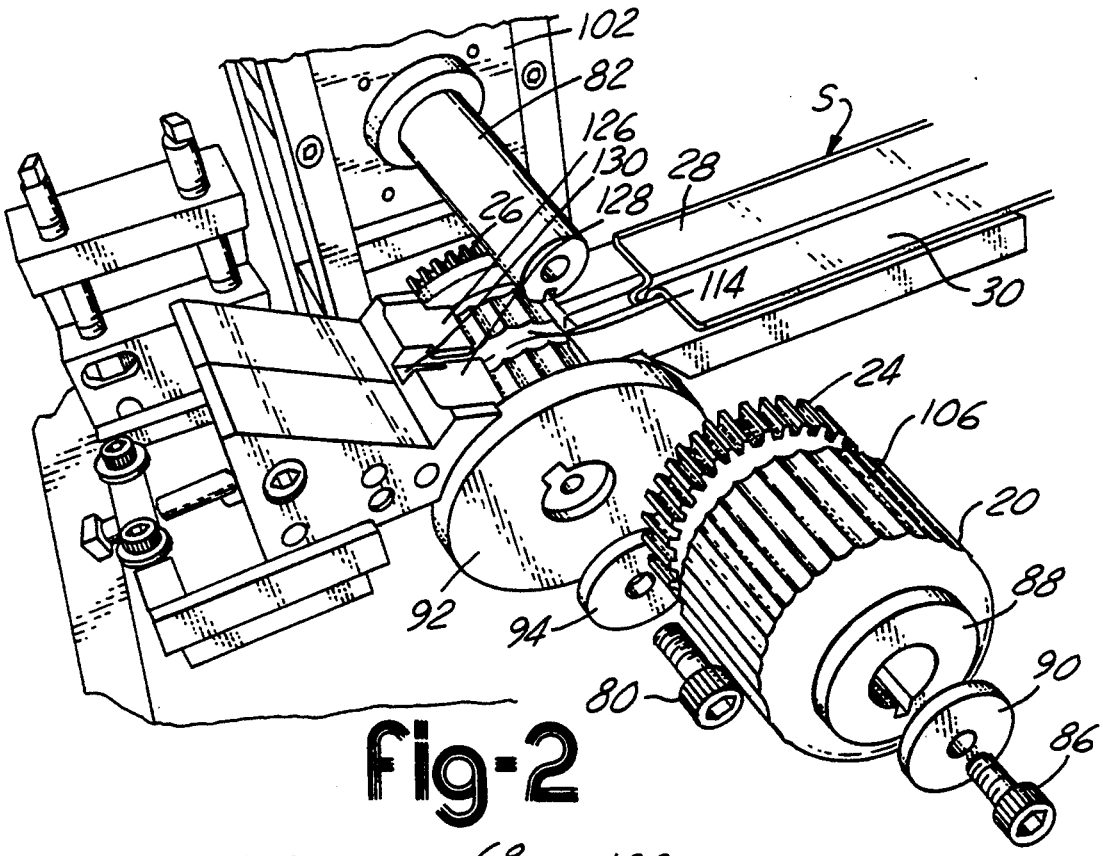
FIG. 2 is a perspective view of the coiling shoe and fluting rolls with the upper roll removed for clarity.
Figure 3:
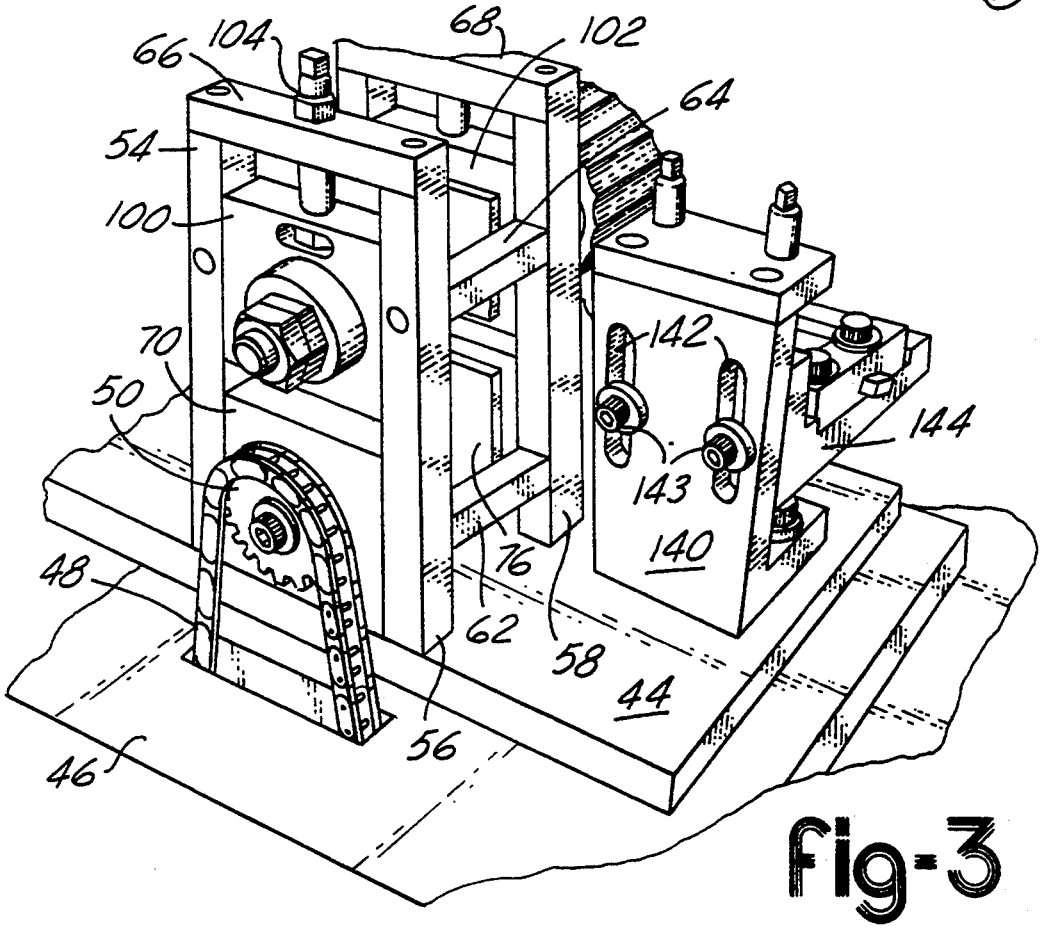
FIG. 3 is a perspective view of the roll driving mechanism and the support for the coiling shoe.

FIGS. 1 and 2 show the general arrangement of a machine embodying the invention. It comprises a pair of cooperating fluting rolls 20 and 22 coupled together by meshing gears 24 and 26 for conjoint rotation and between which the sheet metal strip S is fed to flute the lateral flanges 28 and 30 of the strip. The flanges are joined by a channel-shaped rib 34 which as a top surface 36 (see FIGS. 6 and 8 ) and is on the outside of the coil to be formed in the machine. The rib and flanges define therebetween oppositely opening lateral grooves 38 and 40 which, in the finished form of the coupling ring, receive the ends of duct sections to be joined. The coupling strip and ring are more fully disclosed in U.S. Pat. No. 5,213,374 to which reference will be made periodically hereinafter.

Figure 4:
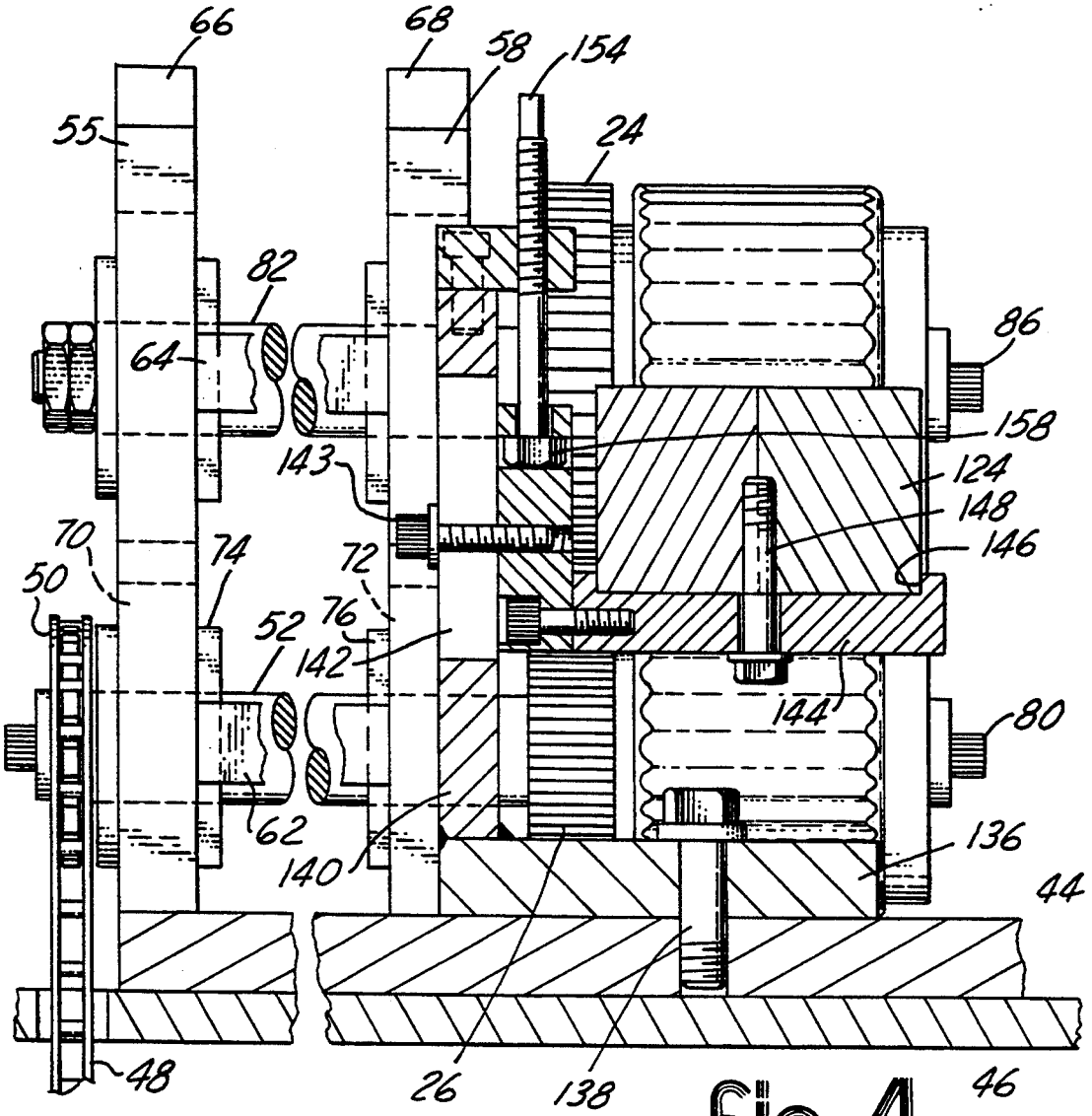
FIG. 4 is a cross-sectional view taken on the line 4—4 of FIG. 1.

The fluting rolls are mounted on a frame 42 having a base 44 which may be mounted on a table 46 or provided with legs (not shown) as desired. A prime mover such as electric motor (not shown) is mounted beneath the table with a drive chain 48 connected to the motor and entrained over a sprocket 50 mounted on a drive shaft 52 (see FIG. 4). Supporting members 54, 56, 58 and 60 upstand from the base 44 and are cross-connected by members 62, 64, 66 and 68 and the like to form a rigid structure for carrying the rolls and related mechanism. The roll shaft 52 is carried by a pair of pillow blocks 70 and 72 rigidly secured to the base and having bearings 74 and 76 therein through which the shaft projects. A key 78 locks the shaft 52 within the roll and a cap screw 80 or the like secures the roll on the shaft.

Figure 6:
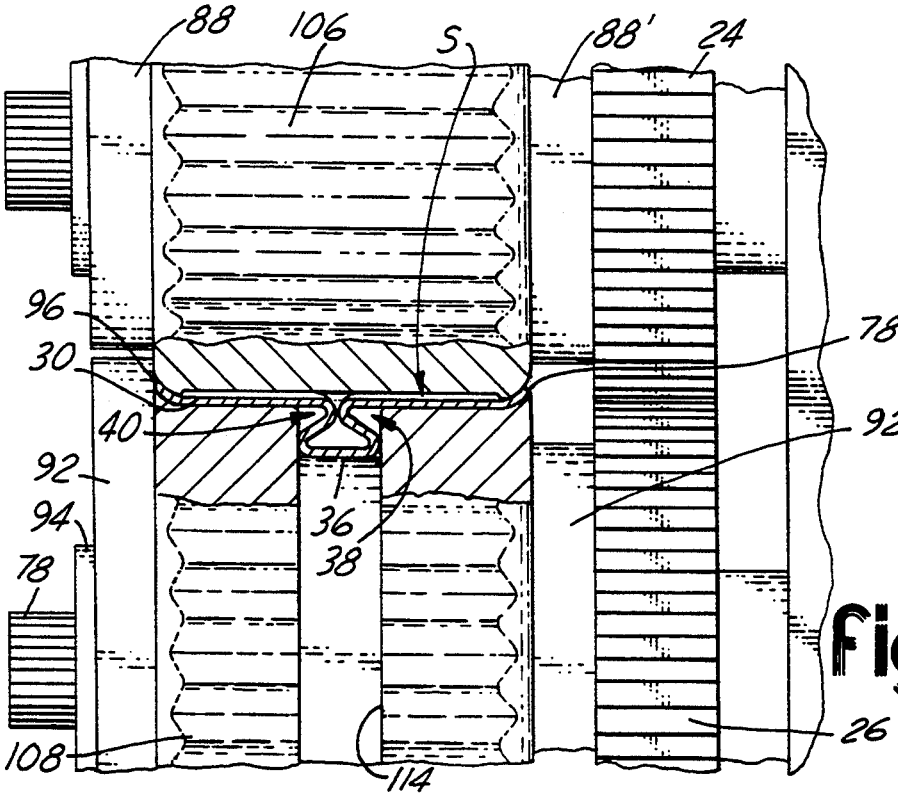
FIG. 6 is a cross-sectional view taken on the line 6—6 of FIG. 5.

The upper roll 20 is carried by a shaft 82 keyed at 84 to the shaft and held by a cap screw 86 or the like to the shaft end. Either integral or separate from the upper roll but in any event keyed to the upper shaft is a disc-like member 88 overlying the outboard end of the upper roll 20. A washer 90 overlies the disc beneath the cap screw head so that the disc is tightly secured to the roll to rotate therewith. A similar but larger disc 92 is keyed to the lower shaft 52 with a washer 94 between it and the cap screw 78. The discs 88 and 92 are of such diameters that their peripheries are juxtaposed and the discs form a barrier or guide for the distal edge 96 of flange 30 as best shown in FIG. 6. Similar discs 88' and 92' are integral with or overlie the inboard ends of the rollers 20 and 22 to guide or contain the distal edge 98 of flange 28 (see FIG. 6).

Shaft 82 is carried by a pair of vertically adjustable pillow blocks 100 and 102 disposed between the uprights 54–60 and guided therebetween by inter-fitting elements (not shown). Vertical adjustment is effected by screw members 104 and 104' as will be well understood in the art. By adjustment of the screw members 104 and 104' the closeness of the rolls 20 and 22 to each other may be adjusted as desired to vary the depth, among other things, of the flutes formed in the flanges 28 and 30 of the strip 32. The teeth of the gears 24 and 26 are sufficiently deep as to allow this limited adjustment. Such gears are themselves keyed to the shafts 52 and 84 in a conventional fashion such that upon driving the lower shaft by the chain and sprocket 48 and 50 the lower gear 26 will drive the upper gear 24 which will in turn drive the upper shaft 82 and in turn the upper roll 20. Thus, conjoint rotation of the rolls is effected and misalignment is avoided.

The peripheries of the fluting rolls are scalloped as at 106 and 108 to provide a succession of ridges 110 and grooves 112 on each roll. (As above and throughout this specification primed reference numerals indicate corresponding structure). The scalloping is so arranged that the ridges of one roll are disposed opposite the grooves of the opposite roll such that as the strip 32 is fed between the rolls, the scalloped periphery of the rolls will form flutes in the lateral flanges 28 and 30 of the strip. To permit this occurring, one of the rolls, in the disclosed embodiment, the lower roll 22, has its scalloped periphery circumaxially grooved at 114 to permit the channel-shaped rib 34 to be received therein and allow the strip to lie flat on the lower roll.

The machine is provided with a strip-supporting in-feed arrangement comprising a pair of rails 116 and 116' spaced apart just sufficiently to slidingly receive therebetween the rib 34 of the strip S to guide the strip to the rolls with the rib properly aligned with the circumaxial groove 114 in the lower roll 22 and with the distal edges 96 and 98 between the barrier discs 88 and 92 as in FIG. 6. The rails are carried by upstanding supports 120 mounted on the base. In-feed rollers 122, either part of the machine or supplementary thereto may be provided to deliver the strips to the supporting rails as depicted in FIG. 1. The rollers 122 may be suitably circumaxially grooved to receive the rib 34 of the strip and guide the strips to the rails.

Figure 10:
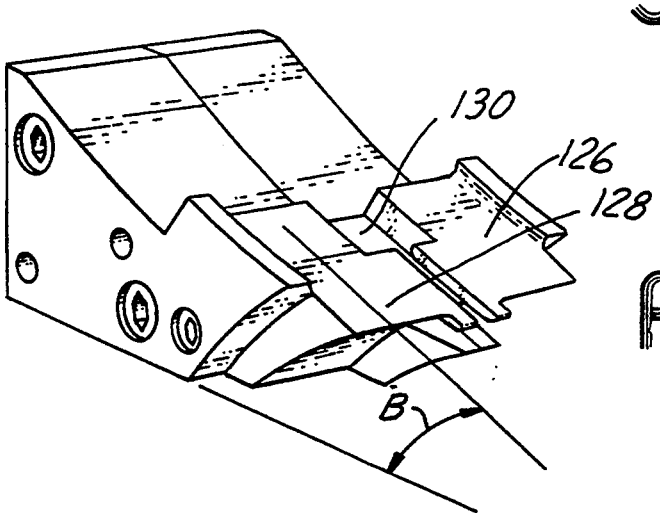
FIG. 10 is an assembled perspective view of the coiling shoe.
Figure 5:
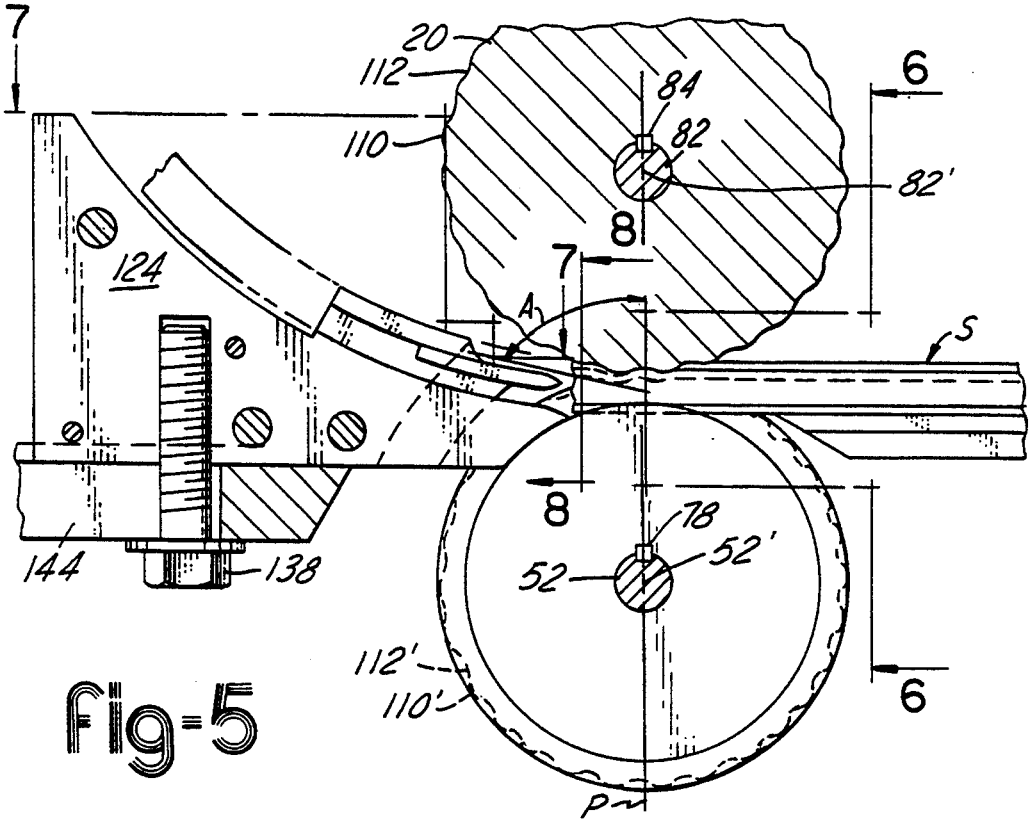
FIG. 5 is a cross-sectional view taken on the line 5—5 of FIG. 1.

A wedge-shaped coiling shoe 124 is mounted on the base 44 and is provided with strip coiling surfaces including a pair of laterally spaced ramps 126 and 128 positioned closely adjacent the fluting rolls 20 and 22 with such pair of ramps receiving therebetween and substantially embracing the rib 34 of the strip emerging from between the rolls. The ramps bear against the lateral flanges 28 and 30 of the strip and serve to deflect them into a coiled configuration. The coiling surfaces of the shoe 124 also include a third ramp 130 (see FIGS. 2 and 10) disposed between said pair of ramps and displaced from the plane thereof and positioned to bear against the top surface 36 of the rib (see FIG. 6) to deflect the rib into a coiled configuration and cooperatively with the ramps 126 and 128 coil the strip with the rib on the outside of the coil. Thus the shoe is so positioned in relation to the fluting rolls that the coiling surfaces or ramps 126, 128 and 130, which are disposed at an angle A (see FIG. 5) to a plane P common to the axes 52' and 82' of the rolls, deflect and bend a strip emerging from between the rolls into a smoothly curved shape having the rib 34 on the outside of the coil.

To prevent undesirable distortion of the laterally opening grooves 38 and 40 of the strip during such coiling action, the flanges 28 and 30 of the strip are fluted by the fluting rolls as above mentioned. But in addition it has been found that the rib 34 must be laterally supported against distortion or collapse and for this purpose a pair of ears 132 and 134 are provided disposed adjacent the aforementioned ramps, which ears are received in the lateral grooves 38 and 40 of the strip and are shaped as best shown in FIG. 8 to substantially fill each groove and prevent collapse thereof during coiling of the strip. In FIG. 9 the ears are shown as essentially being lateral extensions of the ramps and as such bear against the flanges 28 and 30 and the walls of the grooves which they fill. It will be noted from FIGS. 1, 2 and 5 that the coiling shoe has a wedge shaped leading end adapted to enter closely into the space between the rolls for juxtaposition therewith to minimize any gap between the rolls and strip coiling surfaces whereby any tendency to create flat spots at the beginning or end of a strip is minimized.

For convenience in manufacture, the coiling shoe may be made in two halves as shown in FIG. 9 and pinned and bolted together as will be well understood in the art. In FIG. 9 the third ramp 130 is shown made up of ramp portions 130 and 130'. The coiling shoe is carried by mechanism allowing it to be moved horizontally toward or away from the fluting rolls, vertically, and also permit some adjustment of angle A, thereby to "fine tune" the coiling action of the machine.

Such mechanism, as shown in FIGS. 1–4, comprises an L-shaped bracket 136 bolted as at 138 to the base 44. The vertical portion 140 is provided with a pair of parallel slots 142 through which extend bolts 143 for adjustably securing thereto a guideway member 144 having a guideway 146 for receiving the coiling shoe 124. A slot in the bottom of the guideway 146 receives a bolt 148 (FIG. 4) for locking the coiling shoe in adjusted positions closer or farther from the fluting rolls.

An adjustment screw 150 cooperates with the bolt 138 for positioning the coiling shoe. Vertical adjustment of the guideway member and in turn the coiling shoe is controlled by the adjustment screws 152 and 154 carried by an overhanging portion 156 of the bracket 136. The adjustment screws have heads 158 received in slots in the guideway member (see FIGS. 1 and 4) so that the screws may be rotated to move the guideway member vertically to adjust the coiling shoe. It will also be noted that limited angulation of the guideway member and in turn the coiling shoe is afforded by the adjustment screws 152 and 154. There is enough clearance between the bolts 143 and the slots 142 that by rotating screw 154 in one direction and screw 152 in the opposite direction, the guideway may be inclined somewhat thus varying angle A shown in FIG. 5.

Experimentally it has been determined that coils of from 8" diameter to more than 42" diameter may be made on this machine using but three different coiling shoes. One shoe may be made which will coil the strip S to make coupling rings of from 8" to 12" diameter; a second shoe will allow manufacture of rings from 12" to 20"; a third shoe will allow manufacture of rings from 20" to in excess of 40". It appears feasible to make rings in any diameter desired using the machine herein disclosed. The shoes for forming these various size rings will vary principally in the angle B of the ramps, the angle increasing for the smaller diameter rings.

In manufacturing the coupling ring using the machine hereindisclosed, the strip S is coiled and then the meeting ends may be cut so that a ring of precisely the desired diameter results when the ends are abutted. A butt plate is then welded to the ends to complete the ring. If an oval ring is desired, the strip is first coiled, the ends of the coil cut to provide the exact diameter required, and then the coil is cut diametrically opposite the free ends to provide two ring halves. Two uncoiled pieces of the strip of the desired length are then welded using butt blocks to the ends of the ring halves to form the oval coupling ring. It has been found that if the coiling shoe is kept close to the fluting rolls there is less tendency to form "flat spots" at the beginning and end of each strip.

In FIG. 11 there is shown an enlarged fragmentary cross-sectional view of a strip found in this machine and exhibiting shallow pockets 160 and 160]' in the flanges 28 and 30 for receiving sealant material. FIG. 11 corresponds to the strip shown in FIG. 7 of the aforesaid U.S. Pat. No. 5,213,374. These shallow pockets result from allowing a slight distortion of the flanges during the coiling operation.

We claim:

1. A machine for coiling a sheet metal strip having a pair of lateral flanges joined by a channel shaped rib with the rib and flanges defining therebetween oppositely opening lateral grooves, and wherein the rib has a top surface and is on the outside of the coil, comprising, in combination:

a pair of cooperating fluting rolls coupled together for conjoint rotation and between which the strip is fed to flute the flanges of the strip;

one roll of said pair being circumferentially grooved to receive the channel shaped rib of the strip;

a coiling shoe having strip coiling surfaces including a pair of laterally spaced apart ramps positioned closely adjacent the fluting rolls with such pair of ramps receiving therebetween and substantially embracing the rib of a strip emerging from between the rolls and bearing against the lateral flanges;

said coiling surfaces including a third ramp disposed between said pair and positioned to bear against the top surface of the rib;

said shoe being so positioned in relation to the fluting rolls that said coiling surfaces deflect a strip emerging from between the rolls into a curved shape having the rib on the outside of the curve;

a pair of ears disposed adjacent said ramps and received in said oppositely opening grooves of the strip and shaped to substantially fill each groove and prevent collapse thereof during coiling of the strip; and means coupled to the fluting rolls for driving them.

2. The invention defined by claim 1 wherein said pair of ears comprise extensions of said ramps.

3. The invention defined by claim 1 wherein each ear has surface portions bearing against said flanges and the walls of the groove which it fills to limit distortion thereof during coiling of the strip.

4. The invention defined by claim 1 wherein said coiling shoe has a wedge shaped leading end entering the space between the pair of cooperating fluting rolls for juxtaposition therewith to minimize any gap between the rolls and the strip coiling surfaces whereby any tendency to create flat spots at the beginning or end of a strip is minimized.

5. The invention defined by claim 1 wherein said strip coiling surfaces extend over the wedge shaped leading edge of the shoe whereby the coiling surfaces may be juxtaposed to the periphery of the fluting rolls.

6. A machine for coiling a sheet metal strip having a pair of lateral flanges joined by a channel shaped rib with the rib and flanges defining therebetween oppositely opening lateral grooves, and wherein the rib has a top surface and is on the outside of the coil, comprising, in combination:

a pair of cooperating fluting rolls coupled together for conjoint rotation and between which the strip is fed to flute the flanges of the strip;

one roll of said pair being circumferentially grooved to receive the channel shaped rib of the strip;

a wedge shaped coiling shoe having a strip coiling surface for bearing against said flanges with a rib receiving groove bisecting such surface and having a bottom coiling surface for bearing against the top of the rib, said shoe having the narrow end of the wedge shape entering the space between the fluting rolls and disposed with said strip coiling surfaces juxtaposing the said one roll whereby a strip emerging from between the rolls has its rib enter the groove bisecting such surface;

said strip coiling surfaces being disposed at an angle to a plane common to the axes of the fluting rolls and extending in a direction to cause a strip emerging from between the rolls to be coiled with said rib on the outside of the coil;

said coiling shoe at the edges of the rib receiving groove having ears for entering the oppositely opening lateral grooves of the strip and shaped to substantially fill such lateral grooves to prevent collapse of the walls of such lateral grooves during coiling of the strip;

and means coupled to the fluting rolls for driving them.

7. The invention defined by claim 1 wherein strip infeed guide means are provided having a strip supporting surface bisected by a longitudinal groove for receiving the channel shaped rib of the strip while the lateral flanges are supported by the strip supporting surface adjacent the longitudinal groove;

and said strip supporting surface is disposed substantially perpendicularly to a plane common to the axes of said rolls and at an angle to said strip coiling surface.

8. The invention defined by claim 6 wherein strip infeed guide means are provided having a strip supporting surface bisected by a longitudinal groove for receiving the channel shaped rib of the strip while the lateral flanges are supported by the strip supporting surface adjacent the longitudinal groove;

and said strip supporting surface is disposed substantially perpendicularly to a plane common to the axes of said rolls and at an angle to said strip coiling surface.

9. The invention defined by claim 1 wherein means are provided for moving and holding said shoe in adjusted positions closer or farther from said rolls and at varying angles of inclination to vary the radius of curvature of the strip being coiled.

10. The invention defined by claim 6 wherein means are provided for moving and holding said shoe in adjusted positions closer or farther from said rolls and at varying angles of inclination to vary the radius of curvature of the strip being coiled.

* * * * *

UNITED STATES PATENT AND TRADEMARK OFFICE

CERTIFICATE OF CORRECTION

PATENT NO. : 5,337,591

DATED : August 16, 1994

INVENTOR(S) : William H. Fordee

It is certified that error appears in the above-indentified patent and that said Letters Patent is hereby corrected as shown below:

On title page, item [19] "Fordee et al." should read --Fordree et al--.
item [75] "William H. Fordee" should read --William H. Fordree--

Signed and Sealed this

Thirteenth Day of December, 1994

*Attest:*

Bruce Lehman

BRUCE LEHMAN

*Attesting Officer*

*Commissioner of Patents and Trademarks*